US006336448B1

(12) United States Patent
Furuhata et al.

(10) Patent No.: US 6,336,448 B1
(45) Date of Patent: Jan. 8, 2002

(54) IGNITION SEMICONDUCTOR DEVICE

(75) Inventors: Shoichi Furuhata; Minoru Nishio, both of Nagano (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/637,994

(22) Filed: Aug. 15, 2000

(30) Foreign Application Priority Data

Aug. 20, 1999 (JP) ..... 11-233376
Apr. 19, 2000 (JP) ..... 12-117306

(51) Int. Cl.[7] ..... F02P 1/08
(52) U.S. Cl. ..... 123/644; 123/651
(58) Field of Search ..... 123/644, 650, 123/651

(56) References Cited

U.S. PATENT DOCUMENTS 4,735,187 A * 4/1988 Kato ..... 123/651
4,958,608 A * 9/1990 Saito et al. ..... 123/651
5,634,453 A * 6/1997 Taruya et al. ..... 123/651
5,775,310 A * 7/1998 Ito et al. ..... 123/651

* cited by examiner

*Primary Examiner*—Erick Solis
(74) *Attorney, Agent, or Firm*—Kanesaka & Takeuchi

(57) ABSTRACT

In an ignition semiconductor device, a self-shut down circuit forcibly turns off an IGBT when an input signal is continuously applied. The self-shut down circuit is formed of a main-current gradual-reduction circuit having a timer circuit, a capacitor, a resistor, and an FET. When the timer circuit, which is actuated when the input signal is input, counts out, the FET is turned on to cause a capacitor, which is connected parallel to a resistor for producing a reference voltage for a current-limiting circuit, to discharge slowly through the resistor, thereby gradually reducing the reference voltage. Correspondingly, the current-limiting circuit reduces the main current to turn off the IGBT. The slow turn-off operation of the IGBT prevents a high voltage from being generated in the ignition coil. Accordingly, an unwanted high voltage is prevented from being generated in the secondary winding of an ignition coil when an output-stage element is forcibly turned off following the continuous application of an input signal.

15 Claims, 9 Drawing Sheets

IGNITION SEMICONDUCTOR DEVICE

BACKGROUND OF THE INVENTION AND RELATED ART STATEMENT

The present invention relates to an ignition semiconductor device, and in particular to an ignition semiconductor device applicable to an ignition-device system of an internal combustion engine for an automobile.

An ignition-device system of an internal combustion engine for an automobile includes a distributor-less ignition system comprising an ignition coil and an ignition semiconductor device mounted for each cylinder of the internal combustion engine. An ignition semiconductor device used in such a system comprises a switching device for turning on and off a primary current of the ignition coil.

The ignition semiconductor device provided for each cylinder is individually turned on and off by an engine control unit, but this on/off control may not operate properly if, for example, the engine stalls. In particular, if a continuous drive signal is applied to the switching device, a continuous current flows to the primary side to destroy or burn the ignition coil or uncontrollably explode a particular cylinder, causing the engine to vibrate abnormally.

A device for correcting such an abnormal operation is described, for example, in Japanese Patent Application Laid Open No. 8-28415. According to the technique described in this publication, a continuous-conduction prevention circuit is provided such that if current flows through the switching device for a predetermined period of time or longer, by means of a drive signal from the engine control unit, the drive signal input to the switching device is forcibly cut off to stop driving of the switching device. This prevents damages to the switching device and the ignition coil that may be caused by the continuous conduction.

Such an ignition semiconductor device also has a current-limiting circuit to restrain the drive signal sent to the switching device in order to prevent its destruction if an over-current is detected in the switching device.

According to the conventional ignition semiconductor device, the current-limiting circuit prevents over-current through the use of an output stage element, thus preventing thermal destruction of the ignition semiconductor device and the ignition coil, and the continuous-conduction prevention circuit turns off the drive signal and thus the output-stage element of the ignition semiconductor device if a drive signal is continuously applied for a fixed period of time or longer. In particular, however, the turn-off operation performed after the fixed period of time or longer has elapsed is performed at the same speed as a normal operation, so that a high voltage occurs at a secondary winding of the ignition coil, as in normal operation, to ignite a gasoline-air mixture remaining in the cylinder, thereby applying an abnormal rotational force to the engine.

The present invention is provided in view of these points, and it is an object of the invention to provide an ignition semiconductor device that turns off an output-stage terminal after a drive signal has been continuously applied, wherein an unwanted high voltage is prevented from being generated in a second winding of an ignition coil during the turn-off operation.

SUMMARY OF THE INVENTION

To attain the above object, the present invention provides an ignition semiconductor device comprising a switching device connected in series with an ignition coil to controllably turn on or off a current flowing through the ignition coil, a current-limiting device for controlling the switching device so as to limit the current flowing through the ignition coil, and a voltage-limiting circuit for clamping a voltage emitted from the ignition coil. The ignition semiconductor device includes a timer circuit that starts operation in response to an input signal applied to a drive terminal of the switching device and outputs an output signal after a fixed period of time since the input signal has been applied, and a main-current gradual-reduction circuit that operates in response to an output signal from the timer circuit to reduce the current flowing through the switching device despite continuous application of the input signal.

According to such an ignition semiconductor device, if an input signal for turning the switching device on is continuously applied, the timer circuit outputs the output signal and, in response to the output signal, the main-current gradual-reduction circuit reduces the current flowing through the switching device. Consequently, the switching device is turned off more slowly than in the normal operation to cut off the current flowing through a primary winding of the ignition coil at a low speed, thereby restraining a high voltage from being generated in a secondary winding.

BRIEF DESCRIPTION OF THE DRAWINGS

FIGS. 2(A) through 2(C) are views showing the relationship among a secondary voltage, a primary current and a voltage of an ignition coil, wherein FIG. 2(A) shows the peripheries of the ignition coil, FIG. 2(B) shows the variations in the primary current and voltage of the ignition coil, and FIG. 2(C) shows the variations in the secondary voltage of the ignition coil;

DETAILED DESCRIPTION OF PREFERRED EMBODIMENTS

Embodiments of the present invention will be described below in detail with reference to the drawings.

Figure 1:
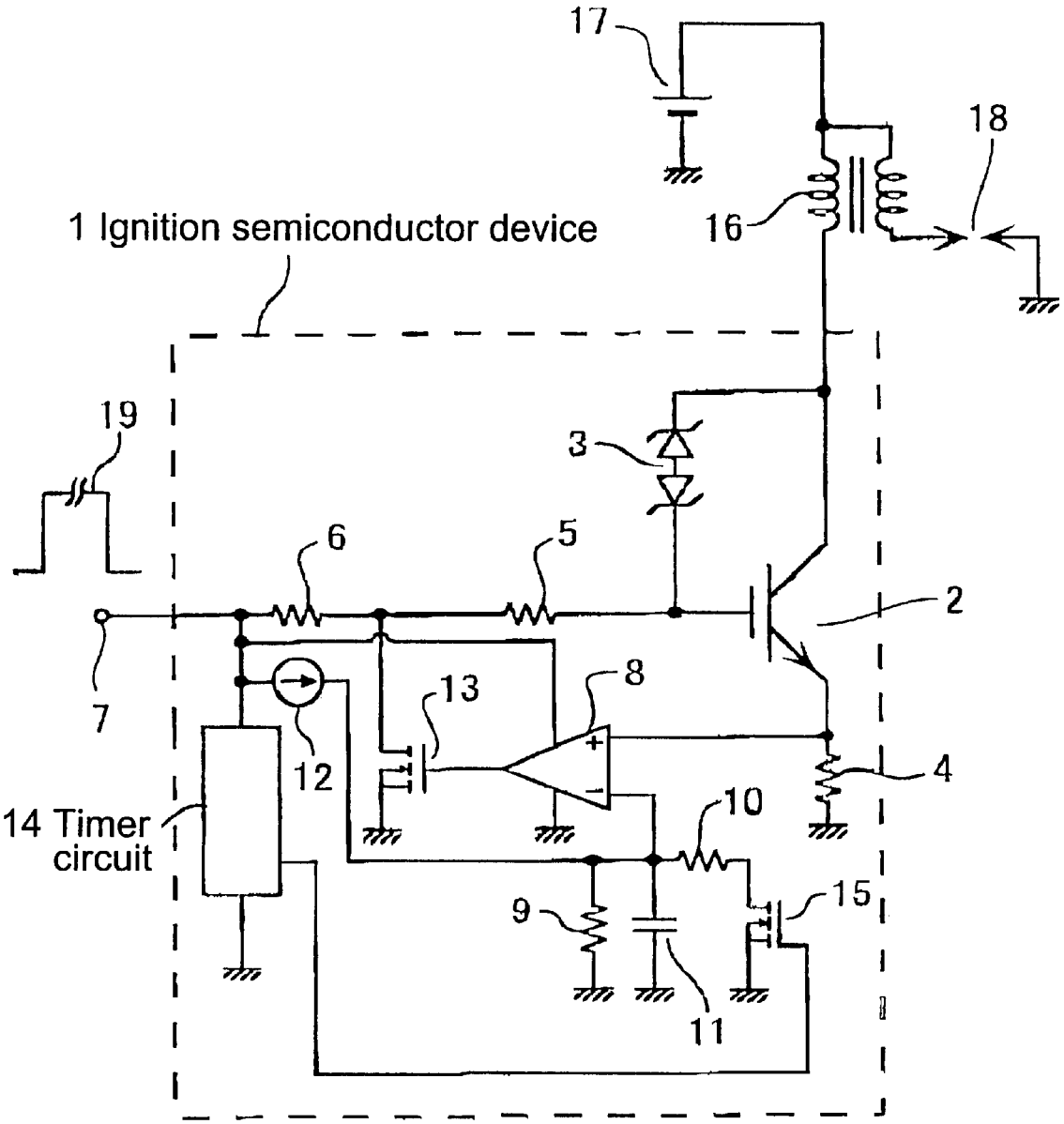
FIG. 1 is a circuit diagram showing an example of a configuration according to a first embodiment of an ignition semiconductor device according to the present invention.

FIG. 1 is a circuit diagram showing a first embodiment of an ignition semiconductor device according to the present invention. An ignition semiconductor device 1 uses an IGBT (Insulated Gate Bipolar Transistor) 2 as a switching device acting as an output-stage element. A Zener diode 3 is connected between a collector and a gate of the IGBT 2 to clamp the voltage emitted from an ignition coil. An emitter of the IGBT 2 is grounded via a shunt resistor 4, and a gate thereof is connected to an input terminal 7 via resistors 5 and 6. A connection between the emitter of the IGBT 2 and the shunt resistor 4 is connected to a non-inverted input of an operational amplifier 8; an inverted input of the operational amplifier 8 is connected to a connection common to resistors 9 and 10, a capacitor 11, and a constant-current element 12; and an output of the operational amplifier 8 is connected to a gate of an FET (Field-Effect Transistor). The FET 13 has a drain connected to a connection common to the resistors 5 and 6 and a grounded source. Additionally, an input terminal 7 is connected to a power terminal of the operational amplifier 8 and to the constant-current element 12 and a timer circuit 14. The timer circuit 14 has its output connected to the gate of the FET 15. The FET 15 has a drain connected to the resistor 10 and a grounded source. Further, the IGBT 2 has a collector connected to the primary winding of an ignition coil 16, with the other end of the primary winding being connected to a battery 17. A secondary winding of the ignition coil 16 is grounded via a gap 18 in an ignition plug.

The shunt resistor 4, the operational amplifier 8, the FET 13, the resistor 5, the resistor 9, the constant-current element 12, and the resistor 6 constitute a current-limiting circuit for limiting the load current flowing through the IGBT 2. In addition, the constant-current element 12 produces a reference voltage for the operational amplifier 8, which is determined by the product of the current flowing through the constant-current element 12 and the resistance value of the resistor 9, and which corresponds to the terminal voltage measured when a limited current flows from the IGBT 2 to the shunt resister 4.

Further, the capacitor 11, resistor 10, FET 15, and timer circuit 14 connected parallel to the resistor 9 constitute a self-shut down circuit for turning off the IGBT 2 when an input signal 19 is continuously applied to the input terminal 7. In particular, according to the present invention, the self-shut down circuit is a main-current gradual-reduction circuit that turns off the IGBT 2 at a low speed. The timer circuit 14 outputs a drive signal to the gate of the FET 15 for a fixed period of time after the input signal 19 has been applied.

In the above-described configuration, when the input signal 19 is applied to the input terminal 7, the IGBT 2 is turned on to cause a current to flow from the battery 17 via the primary winding of the ignition coil 16 and the IGBT 2. Subsequently, when the input signal 19 is turned off within a period of time shorter than the operation time of the timer circuit 14, the IGBT 2 is turned off to cut off a current flowing through the primary winding of the ignition coil 16. Consequently, energy stored in the primary winding of the ignition coil 16 is induced in the secondary winding to generate a high voltage therein in order to cause discharge in the gap 18, thereby igniting a mixture in a cylinder. This turn-off operation of the IGBT 2 during a normal operation depends on the input capacity of the IGBT 2, the resistance values of the resistors 5 and 6 and an input-signal circuit, and is generally performed at a speed of 50 microseconds or less.

When the input signal 19 is applied to the input terminal 7, the potential of the input signal 19 is used as the power voltage for the operational amplifier 8, and the constant-current element 12 supplies a constant current to the resistor 9 in order to provide a reference voltage for the inverted input of the operational amplifier 8. Accordingly, the current-limiting circuit of this ignition semiconductor device 1 is actuated. When the IGBT 2 is turned on, a current flows through the shunt resistor 4. If, however, the current increases abnormally so that the terminal voltage of the shunt resistor 4 exceeds the reference voltage, the output potential of the operational amplifier 8 is inverted to turn on the FET 13 in order to connect the connection common to the resistors 5 and 6 to the earth, thereby cutting off the input signal 19 to the gate of the IGBT 2 in order to forcibly turn off the IGBT 2.

Next, the operation of the ignition semiconductor device performed when the input signal 19 is continuously applied to the input terminal 7 due to stalling of the engine or the like will be described with reference to FIGS. 2(A) through 2(C).

Figure 2A:
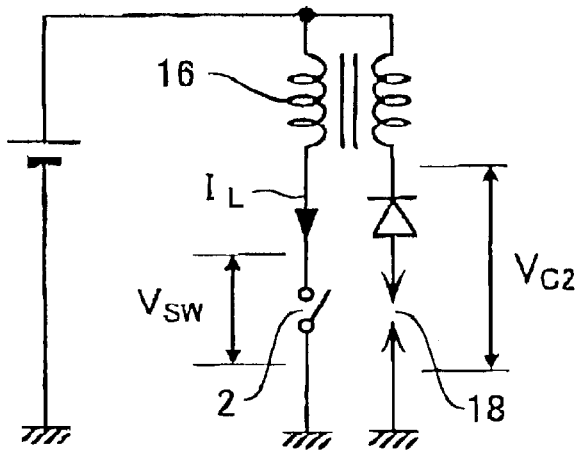
Figure 2B:
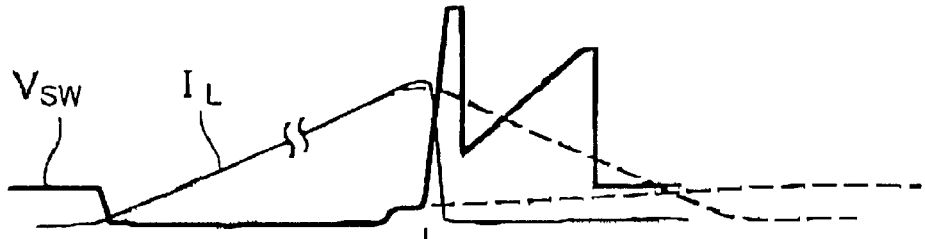
Figure 2C:
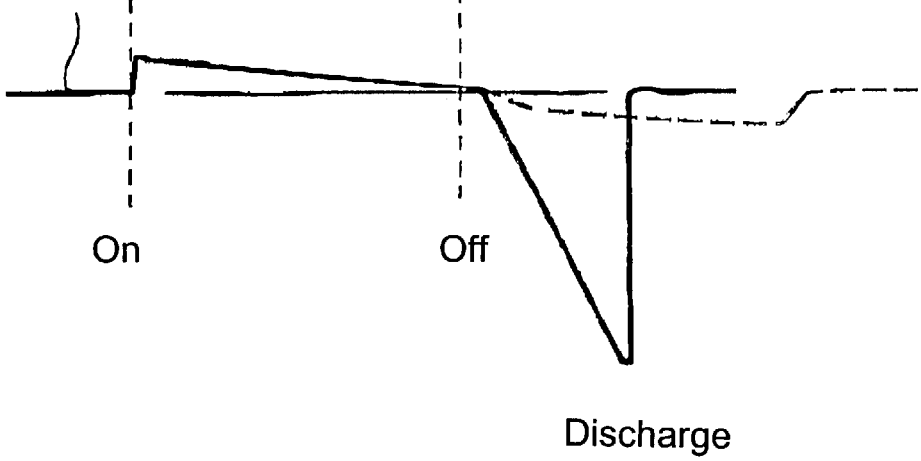

FIGS. 2(A) through 2(C) show the relationship between the secondary voltage, and the primary current and the voltage of the ignition coil. FIG. 2(A) shows the periphery of the ignition coil, FIG. 2(B) shows the variations in the primary current and the voltage of the ignition coil, and FIG. 2(C) shows the variations in the secondary voltage of the ignition coil. In FIG. 2(A), the IGBT 2 is represented by a switch, the current flowing through the primary winding of the ignition coil 16 is denoted by $I_L$ the collector-emitter voltage of the IGBT 2 is denoted by $V_{SW}$, and the voltage at a gap 18 occurring in the secondary winding is denoted by $V_{C2}$.

First, the normal operation of the ignition semiconductor device 1 will be explained. When the IGBT 2 is turned on, the voltage $V_{SW}$, falls from the battery voltage to the ground potential, while the current $I_L$ flowing through the primary winding of the ignition coil 16 rises gradually, as shown in FIG. 2(B). Subsequently, when the current $I_L$ reaches a predetermined current value, the current-limiting circuit is actuated to limit the current value in order to slightly raise the voltage $V_{SW}$, When the IGBT 2 is turned off, the current $I_L$, falls to zero, while the voltage $V_{SW}$, rises rapidly. When clamped at a Zener voltage determined by the Zener diode 3, the voltage $V_{SW}$ induces energy from the primary winding in the secondary winding and then reduces. The induced energy generates a minus potential in the secondary winding, and the voltage $V_{C2}$ at the gap 18 rises in the minus direction as shown in FIG. 2(C). The voltage generated in the secondary winding is returned to the primary winding after a certain phase delay, thereby increasing the voltage $V_{SW}$, which has fallen. When the voltage at the secondary winding, that is, the voltage $V_{C2}$ at the gap 18, has risen to a certain value, discharge occurs at the gap 18 to lower the voltages at the primary and secondary windings of the ignition coil 16. The voltage $V_{SW}$, becomes equal to the battery voltage, while the voltage $V_{C2}$ at the gap 18 becomes zero.

Next, a case in which the engine stalls followed by the continuous application of the input signal 19 will be explained. When the input signal 19 has been applied for a fixed period of time, the timer circuit 14 outputs a drive signal to the gate of the FET 15. The FET 15 is then turned on to discharge the charge from the capacitor 11, via the resistor 10. The discharge speed is determined by the time constants for the capacitor 11 and resistor 10.

When the timer circuit 14 outputs a drive signal to the FET 15, the IGBT 2 is in a condition that a current is limited by the operational amplifier 8, the FET 13, and other elements. In this state, when the capacitor 11 is discharged, the reference voltage at the operational amplifier 8 falls gradually. Since the IGBT 2 controls the current so that the terminal voltage of the shunt resistor 4 and the reference voltage at the operational amplifier 8 become equal, the current $I_L$ is gradually reduced along with the reference voltage, as shown by the broken line in FIG. 2(B). Thus, the voltage $V_{SW}$, rises gradually from the potential measured during the current limitation, as shown by the broken line, while the voltage $V_{C2}$ at the gap 18 varies as shown in FIG. 2(C). In this manner, the current-limit value of the IGBT 2 is varied to turn off the IGBT 2 at a low speed in order to hinder the voltage $V_{C2}$ at the gap 18 from increasing to a value at which discharge occurs, thereby preventing unwanted explosion.

The above-described ignition semiconductor device 1 comprising the current-limiting circuit for limiting the load current flowing through the IGBT 2 and the main-current gradual-reduction circuit for turning off the IGBT 2 at a low speed can be constructed by using a hybrid integrated circuit comprising a combination of these components. For example, the components can be housed in a single package by, for example, mounting on a ceramic substrate silicon chips constituting the IGBT 2, the operational amplifier 8, the constant-current element 12, the timer circuit 14 and the FETs 13, 15; printed resistors or resistor chips as the resistors 5, 6, 9, 10; a resistor chip as the shunt resistor 4; and a capacitor chip as the capacitor 11; and connecting these chips together with wires, and then sealing them with resin.

Alternatively, the ignition semiconductor device 1 can be housed in a single package by using only multiple semiconductor chips (bare chips) constituting the IGBT 2, the current-limiting circuit, and the main-current gradual-reduction circuit.

Further, the ignition semiconductor device 1 can be constructed by using a single chip by providing all functions of the ignition semiconductor device 1 on a single silicon substrate.

Figure 3:
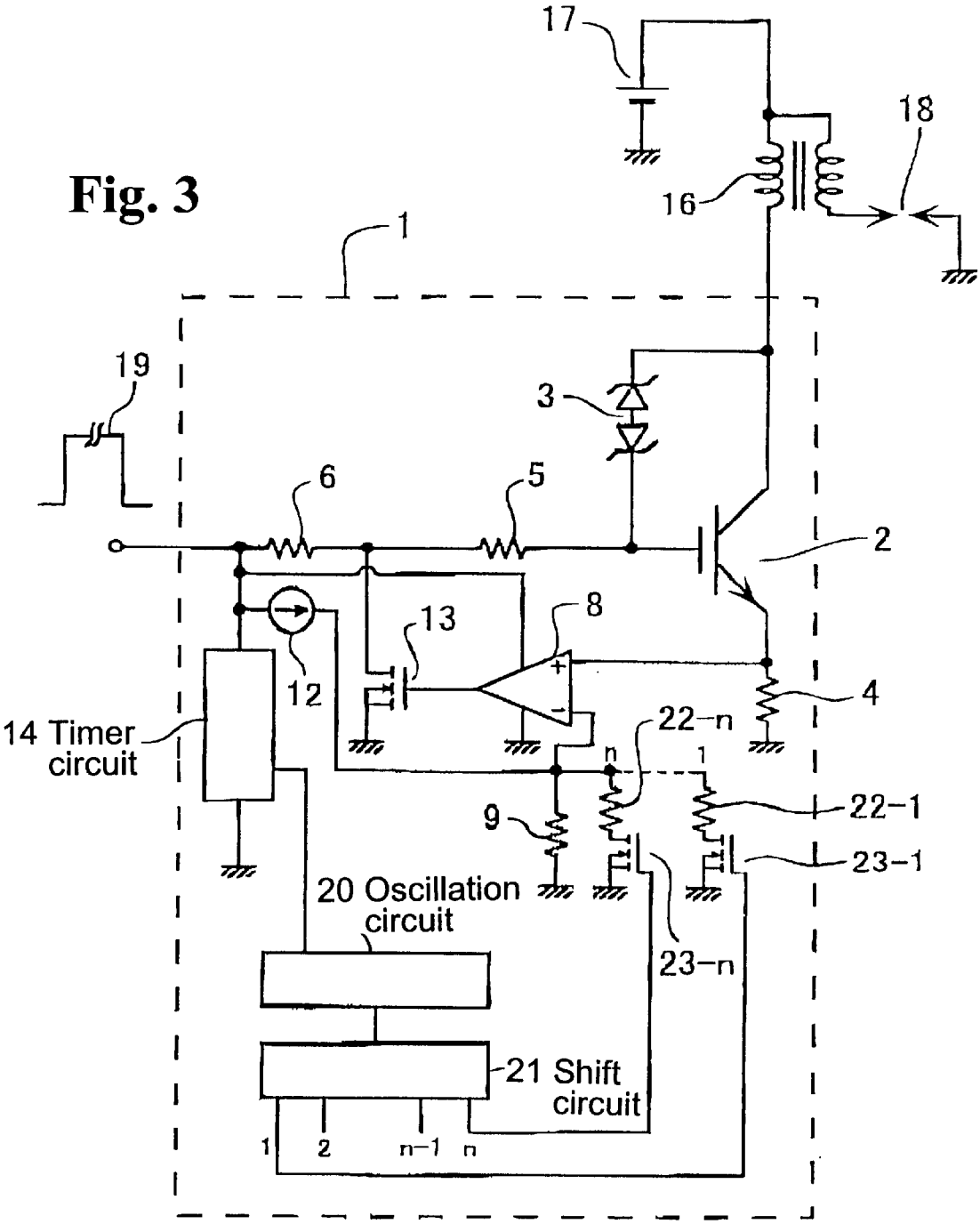
FIG. 3 is a circuit diagram showing an example of a configuration according to a second embodiment of an ignition semiconductor device.

FIG. 3 is a circuit diagram showing an example of a configuration according to a second embodiment of an ignition semiconductor device. In FIG. 3, the same elements as shown in FIG. 1 are denoted by the same reference numerals, and detailed descriptions thereof are omitted. According to this embodiment, the main-current gradual-reduction circuit comprises a timer circuit 14, an oscillation circuit 20, a shift circuit 21, n sets of resistors 22-1 to 22-n, and FETs 23-1 to 23-n.

The timer circuit 14 outputs a main-current gradual-reduction start signal after a fixed period of time since the input signal 19 has been applied, and has its output connected to the oscillation circuit 20. The output of the oscillation circuit 20 is further connected to a shift circuit 21 having n outputs connected to the gates of FETs 23-1 to 23-n, respectively. Each series circuit comprising each of the resistors 22-1 to 22-n and a corresponding one of the FETs 23-1 to 23-n is connected parallel to the resistor 9, which generates the reference voltage for the operational amplifier 8. A parallel circuit comprising the resistor 9 and the resistors 22-1 to 22-n reduces the reference voltage for the operational amplifier 8 in stepwise manner.

The oscillation circuit 20 determines the speed of the stepwise reduction, and the shift circuit 21 determines which FET is to be driven, that is, the FET 23-1, the FET 23-n, or either of the FETs 23-1 and 23-n. In case the resistors 22-1 to 22-n have the same resistance value, if the drive signal is sequentially provided for the first FET 23-1 to the n-th FET 23-n, the end-to-end resistance value of the resistor 9 becomes equal to the parallel value of the resistor 9 and n resistance values, which falls gradually. The end-to-end voltage of the resistor 9 is determined in accordance with Ohm's law (resistance×current=voltage), thereby allowing the collector current flowing through the IGBT 2 to be gradually reduced. This in turn restrains a high voltage from being generated in the secondary. winding of the ignition coil 16.

Figure 4:
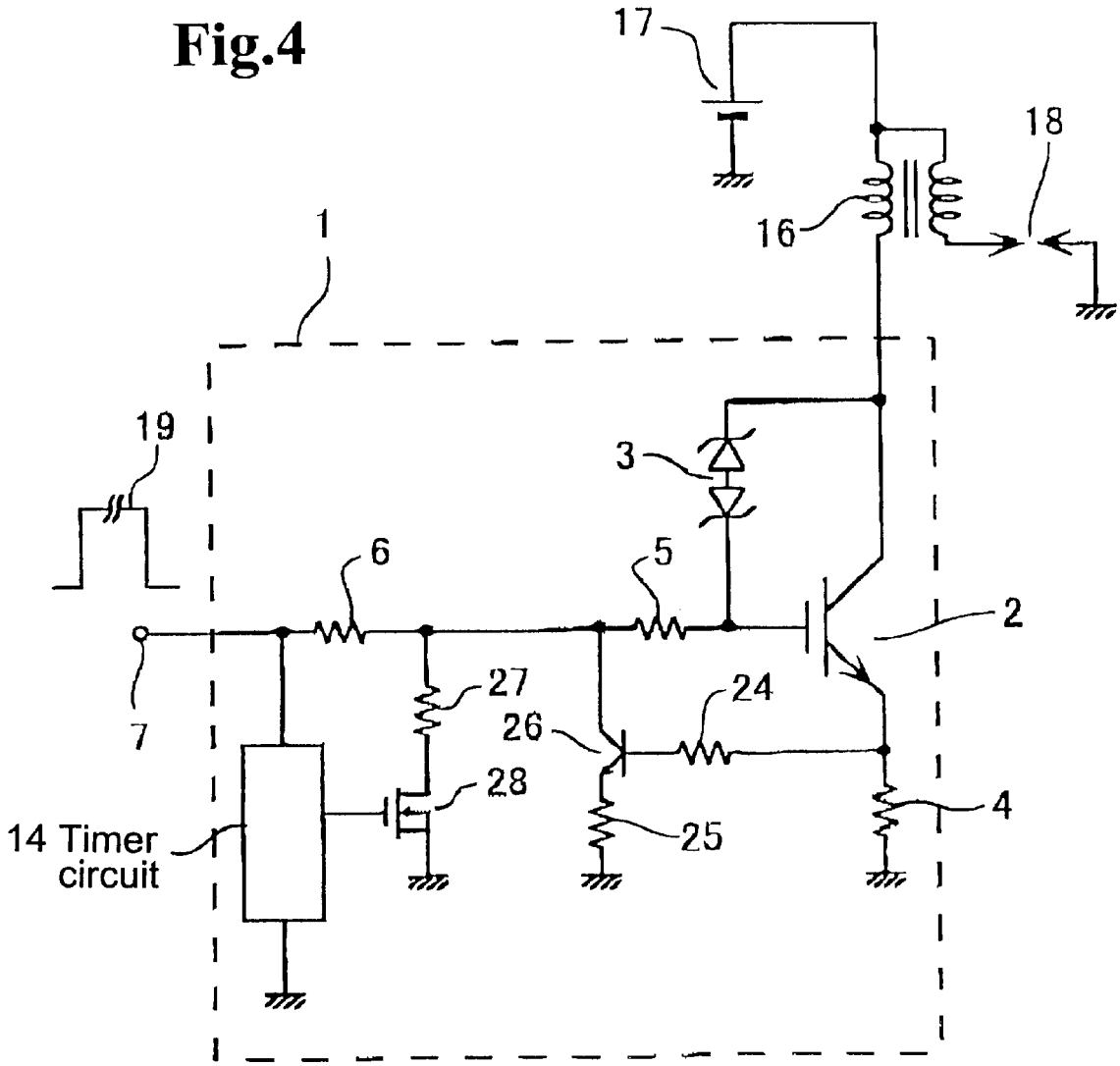
FIG. 4 is a circuit diagram showing an example of a configuration according to a third embodiment of an ignition semiconductor device.

FIG. 4 is a circuit diagram showing an example of a configuration according to a third embodiment of an ignition semiconductor device. In FIG. 4, the same elements as shown in FIG. 1 are denoted by the same reference numerals, and detailed descriptions thereof are omitted. According to this embodiment, the current-limiting circuit comprises resistors 24, 25, and a transistor 26, and a main-current gradual-reduction circuit comprises the timer circuit 14, a resistor 27, and an FET 28.

In the current-limiting circuit, a connection between the emitter of the IGBT 2 and the shunt resistor 4 is connected to a base of a transistor 26 via a resistor 24, a collector of the transistor 26 is connected to a connection common to the resistors 5 and 6, and an emitter thereof is grounded via a resistor 25. In the main-current gradual-reduction circuit, the output of the timer circuit 14 is connected to a gate of an FET 28, and a drain of the FET 28 is connected to a connection common to the resistors 5 and 6, while the source thereof is grounded.

When the input signal 19 is applied to the input terminal 7, the IGBT 2 is turned on. In increasing the main current, when the terminal voltage of the shunt resistor 4, which is originated from the main current, exceeds a forward bias voltage of the transistor 26, the transistor 26 is turned on to bring the potential at the connection common to the resistors 5 and 6 closer to the earth-potential value in order to reduce the gate voltage of the IGBT 2, thereby reducing and limiting the main current to a predetermined value.

Then, if the input signal 19 is continuously applied to the input terminal 7, the timer circuit 14 outputs the drive signal after a predetermined period of time since the input signal 19 has been applied. Accordingly, the FET 28 is turned on to shunt the input signal 19 to the resistor 27 in order to diminish the gate voltage of the IGBT 2. In addition, the charge stored in the gate of the IGBT 2 is drained or emitted via the resistors 5 and 27 to cause the IGBT 2 to start a turn-off operation. The turn-off speed of the IGBT 2 is determined by the resistors 5 and 27, and it can be reduced by increasing the resistance value of the resistor 27. That is, the current flowing through the IGBT 2 and the primary winding of the ignition coil 16 can be reduced slowly to restrain a high voltage from being generated in the secondary winding of the ignition coil 16.

Figure 5:
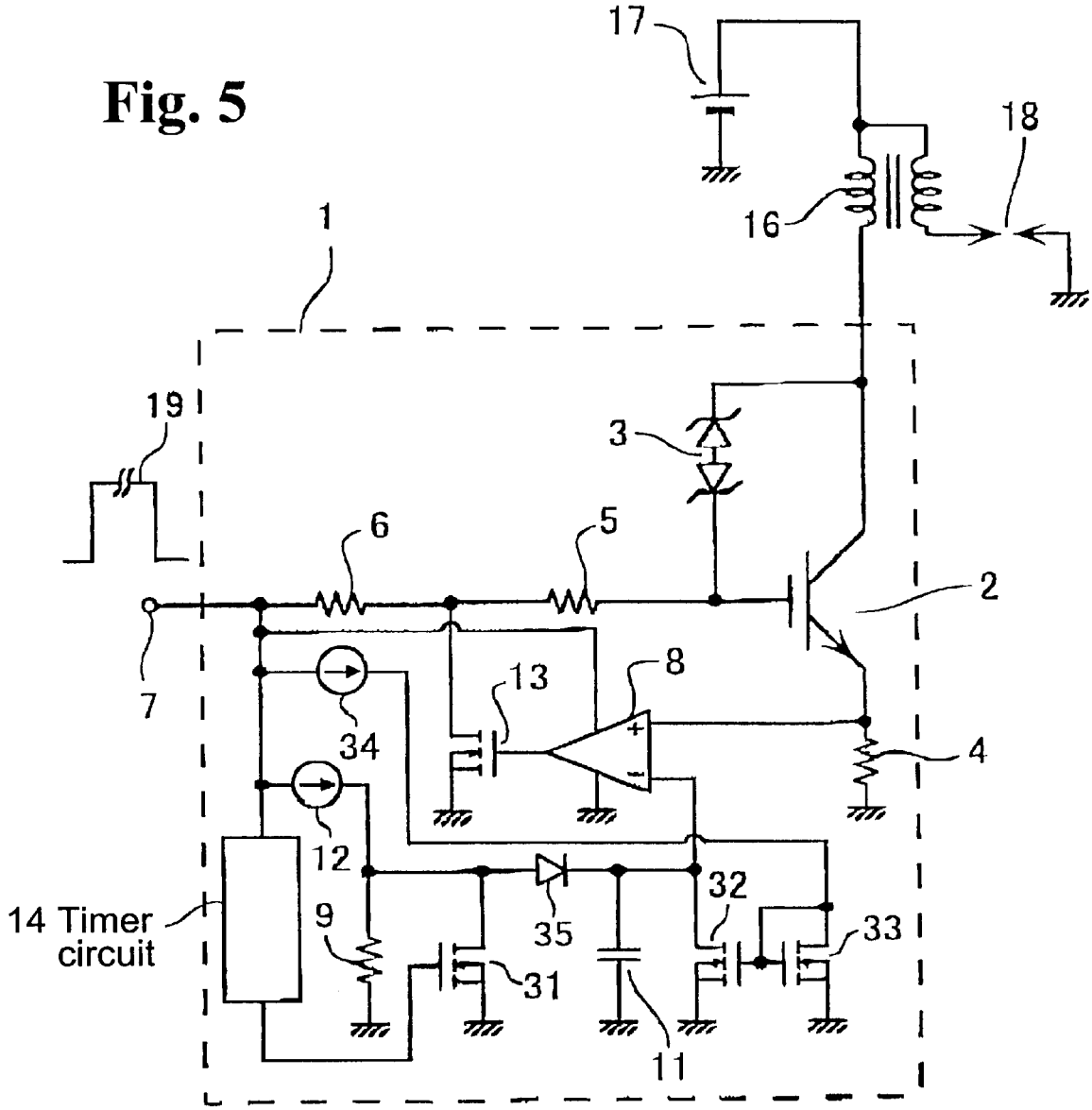
FIG. 5 is a circuit diagram showing an example of a configuration according to a fourth embodiment of an ignition semiconductor device.

FIG. 5 is a circuit diagram showing an example of a configuration according to a fourth embodiment of an ignition semiconductor device. In FIG. 5, the same elements as shown in FIG. 1 are denoted by the same reference numerals, and detailed descriptions thereof are omitted. According to this embodiment, the main-current gradual-reduction circuit comprises a constant-current element 12, the resistor 9, a diode 35, the capacitor 11, the timer circuit 14, and FETs 31, 32, 33.

In the main-current gradual-reduction circuit, the capacitor 11 is connected so that a part of the current flowing from the constant-current element 12 to the resistor 9 is charged via the diode 35, and is also connected to a drain of the FET 32 for the constant-current discharge. The source of the FET 32 is grounded, and a gate thereof is connected to a gate and a drain of the FET 33. The drain of the FET 33 is connected to the constant-current element 34, and the source thereof is grounded. The FETs 32 and 33 constitute a current mirror circuit, and the capacitor 11 carries out the constant-current discharge at a current determined by the constant-current element 34. The output of the timer circuit 14 is connected to a gate of the FET 31, and the drain of the FET 31 is connected to a connection common to the resistor 5 and the diode 35, while the source thereof is grounded.

When the input signal 19 is applied to the input terminal 7, the IGBT 2 is turned on. In increasing the main current, when the terminal voltage of the shunt resistor 4, which is originated from the main current, exceeds a reference voltage determined by the constant-current element 12 and the resistor 9, the FET 13 is turned on to bring the potential at the connection common to the resistors 5 and 6 closer to the earth-potential value in order to reduce the gate voltage of the IGBT 2, thereby reducing the main current and limiting it to a predetermined value.

Then, if the input signal 19 is continuously applied to the input terminal 7, the timer circuit 14 outputs a drive signal after a predetermined period of time since the input signal 19 has been applied, thereby turning on the FET 31 to set an anode of the diode 35 at the earth potential. At this point, the diode 35 hinders the capacitor 11 from being charged while preventing a discharge current from the capacitor 11 from flowing into the resistor 9 and the FET 31. Accordingly, the FET 32 discharges, at a constant current, the charge in the capacitor 11.

When the timer circuit 14 outputs the drive signal to the FET 31, the IGBT 2 is in a condition that a current is limited by the operational amplifier 8, the FET 13, and other elements. In this state, when the capacitor 11 is discharged, a constant current flows through the FET 32, and the constant current is determined by the ratio between the FET 32 and the FET 33 through which a constant current determined by the constant-current element 34 flows. Consequently, the capacitor 11 is slowly discharged to gradually reduce the reference voltage of the operational amplifier 8. As a result, the current flowing through the IGBT 2 and the primary winding of the ignition coil 16 is slowly reduced to restrain a high voltage from being generated in the secondary winding of the ignition coil 16.

Most automobiles use 12-V batteries, but in cold areas, two batteries may be connected in series to start the engine or, even in summer, if the battery is unable to restart the engine due to degradation, the power supply of another automobile may be used to start the engine. Naturally, an automobile with a 12-V system may use the power supply from an automobile of a 24-V system. In such a case, if the input signal 19 is continuously applied to the input terminal 7, a high voltage may be applied to the IGBT 2, so that the IGBT 2 may be thermally destroyed during the current-limiting operation.

If, for example, the battery voltage is 12 V, the current-limit value is 20 A, and the ignition-coil resistance is 0.5Ω, the collector loss of the IGBT 2 will be 20 A×(12 V−20 A×0.5Ω)=40 W. On the other hand, if a 24-V power supply is used for a circuit having a battery voltage of 12 V, a current-limit value of 20 A, and an ignition-coil resistance of 0.5Ω, then the collector loss will be 20 A×(24 V−20 A×0.5)=280 W.

Thus, the IGBT 2 acting as the switching device must be prevented from being thermally destroyed even if the power-supply voltage is higher than that in the normal operation. An ignition semiconductor device having such a function will be described below.

Figure 6:
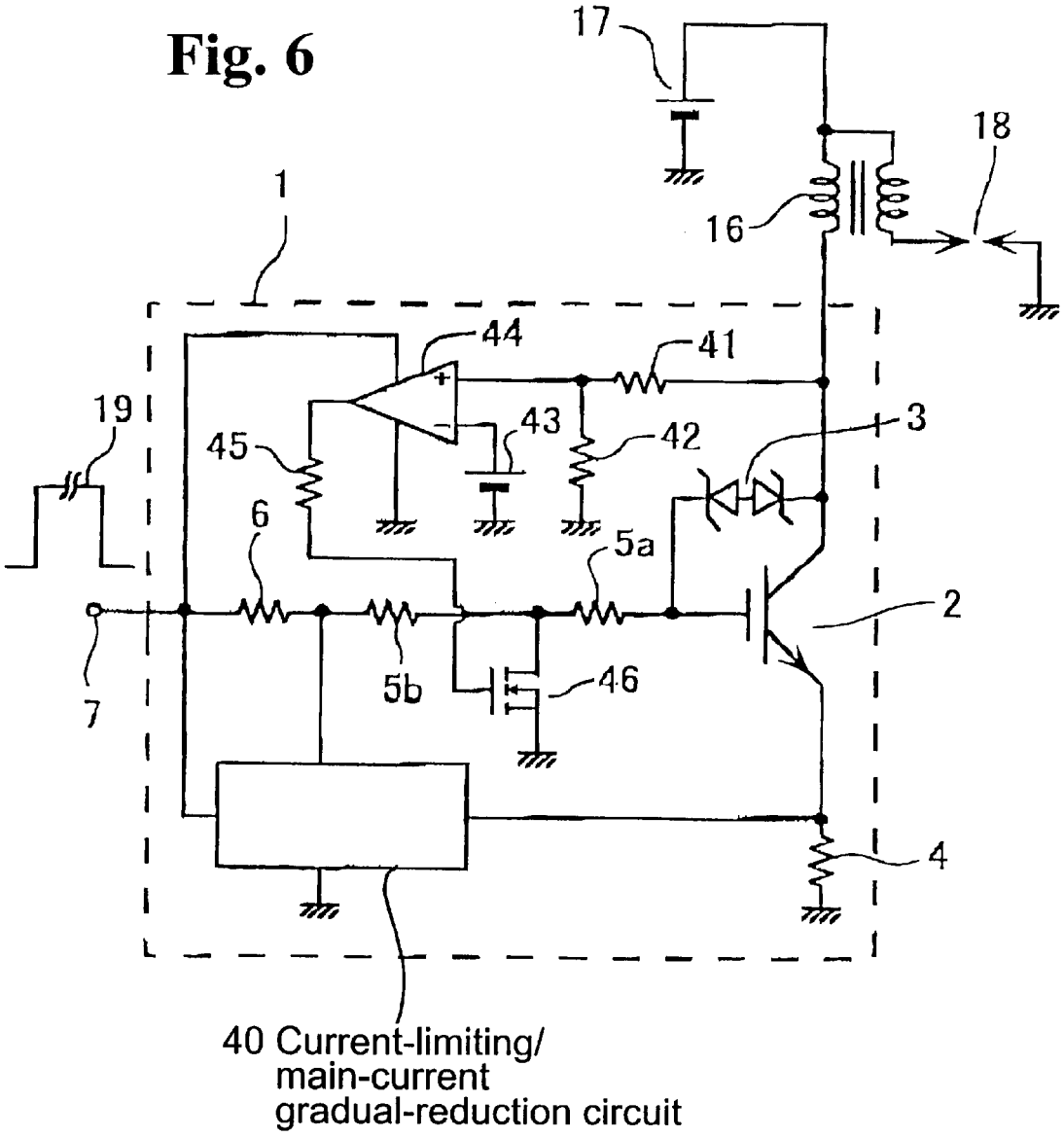
FIG. 6 is a circuit diagram showing an example of a configuration according to a fifth embodiment of an ignition semiconductor device.

FIG. 6 is a circuit diagram showing an example of a configuration according to a fifth embodiment of an ignition semiconductor device. In FIG. 6, the same elements as shown in FIG. 1 are denoted by the same reference numerals, and detailed descriptions thereof are omitted. This embodiment comprises a current-limiting/main-current gradual-reduction circuit 40 including the current-limiting circuit and the main-current gradual-reduction circuit, as well as a main-current cutoff circuit for cutting off the main current flowing through the IGBT 2 at a high speed if the battery 17 is of a specified voltage or higher and if the input signal 19 is being continuously input.

The main-current cutoff circuit comprises voltage-dividing resistors 41 and 42 for detecting the collector voltage of the IGBT 2, a reference-voltage line 43 for setting a specified voltage, an operational amplifier 44 having a non-inverted input connected to a connection common to the resistors 41 and 42 and an inverted input connected to the reference-voltage source 43, a resistor 45 connected to an output of the operational amplifier 44, and an FET 46 having a drain connected to a connection between two resistors 5*a* and 5*b* connected in series with the gate of the IGBT 2, a grounded source, and a gate connected to the output of the operational amplifier 44 via the resistor 45. The power terminal of the operational amplifier 44 is connected to the input terminal 7. Thus, the input signal 19 and the collector voltage of the IGBT 2 are monitored, and the gate voltage of the IGBT 2 is forcibly lowered to a drive voltage at which the IGBT 2 can not maintain the ON state if the input signal 19 is continuously applied when the collector voltage is of a specified value or higher.

In this configuration, if the input signal 19 is continuously applied, the IGBT 2 uses the current-limiting/main-current gradual-reduction circuit 40 to cause a fixed main current to flow, and then reduces the main current slowly. In this case, a collector voltage of the IGBT 2 during the current-limiting operation comes to a value equal to a value wherein the product of the ignition-coil resistance and the current-limit value is deducted from the voltage of the battery 17, that is, $V_{CE}=V_B-RCA\times Ic1$, where $V_{CE}$ denotes the collector-emitter voltage of the IGBT 2, $V_B$ denotes the battery voltage, Rc denotes the ignition-coil resistance, and Ic1 denotes the current-limit value.

In this case, since the current-limit value does not increase significantly even if the battery voltage is high, the collector voltage of the IGBT 2 increases in proportion to the battery voltage.

In this configuration, the operational amplifier 44 produces an output based on the collector-voltage value determined by the resistors 41 and 42 and the reference-voltage source 43, to drive an FET 46. Since the FET 46 is connected parallel between the gate and the emitter of the IGBT 2, it forcibly reduces the gate voltage of the IGBT 2 to that of the ground, despite the operation of the current-limiting/main-current gradual-reduction circuit 40, to quickly transfer the IGBT 2 to a turned-off state.

A portion of the collector voltage applied to a non-inverted input of the operational amplifier 44 may be obtained from a Zener diode instead of the resistor 41. Alternatively, a Zener diode and the resistor 41 may be connected in series. Further, a constant-current element may be connected in series with the resistor 41 so that the collector voltage can be shared by the constant-current element when it reaches a fixed value.

Alternatively, the current-limiting/main-current gradual-reduction circuit 40 may comprise the current-limiting circuit and main-current gradual-reduction circuit illustrated in FIG. 1, 4, or 5.

Next, as described above, although most automobiles use 12-V batteries, the battery voltage may become insufficient to start the engine in cold areas or if the battery is degraded. In this case, the input signal 19 for turning on or off the switching device may be controlled so as to have an ON time longer than that when the battery voltage is normal. Thus, the above-described main-current gradual-reduction circuit acting as a protective circuit when the input signal 19 is input for an extraordinarily long time may be configured so as to operate if the input signal is controlled so as to operate for a time longer than that when the battery voltage is normal, and if the amount of time to which the input signal has actually been input exceeds this controlled value. With this configuration, however, if the battery voltage increases, the switching device may be thermally destroyed. To prevent such an occurrence, it is necessary to shorten a timeout time until the timer circuit outputs an output signal to cause the main-current gradual-reduction circuit to perform a gradual-reduction operation when the battery voltage reaches a certain value. To achieve this, the switching device must monitor the battery voltage.

In general, in a circuit configuration in which one end of the main-current circuit of the switching device is connected to the battery via the primary winding of the ignition coil 16, which is a load, while the other end is grounded, the switching device can not directly monitor the battery voltage. Accordingly, to monitor the battery voltage, another terminal is required in order to directly receive voltage signals from the battery. An ignition semiconductor device will be described below that has a function for monitoring the battery voltage to prevent thermal destruction of the switching device, without the need for the above-described additional terminal.

Figure 7:
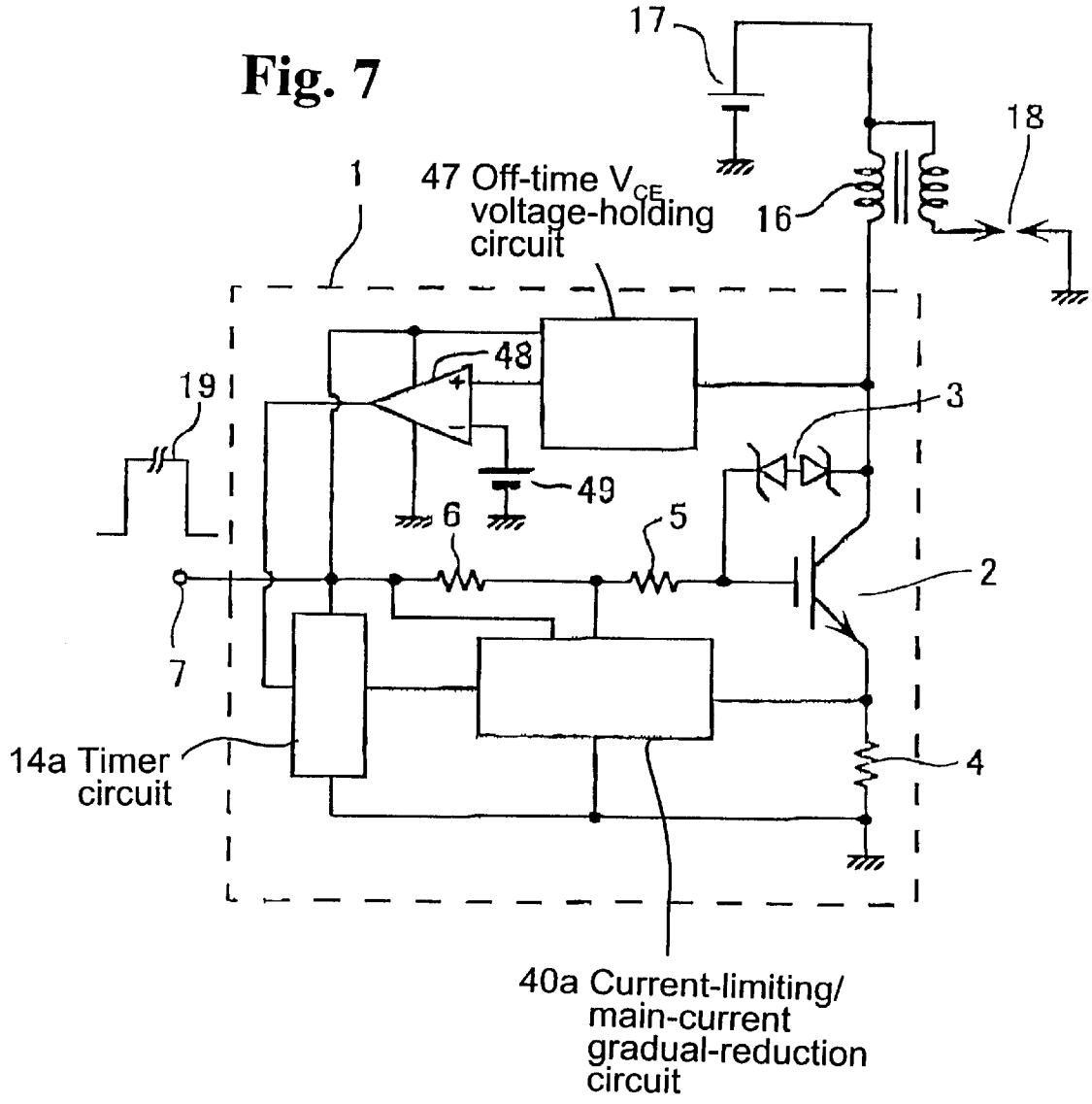
FIG. 7 is a circuit diagram showing an example of a configuration according to a sixth embodiment of an ignition semiconductor device.

FIG. 7 is a circuit diagram showing an example of a configuration according to a sixth embodiment of an ignition semiconductor device. In FIG. 7, the same elements as shown in FIG. 1 are denoted by the same reference numerals, and detailed descriptions thereof are omitted. According to this embodiment, a circuit for monitoring the voltage of the battery 17 comprises an off-time $V_{CE}$ voltage-holding circuit 47 for detecting and holding the voltage $V_{CE}$ between the collector and emitter of the IGBT 2 when it is turned off, an operational amplifier 48 for determining whether the voltage of the battery 17 is higher, and a reference-voltage source 49 for the purpose of conducting voltage comparisons. These elements constitute a timer control circuit. For explanatory purposes, this figure shows the monitor circuit constituting the main current gradual-reduction circuit, as two independent circuits, i.e. a monitor circuit 14*a* and a current-limiting/main-current gradual-reduction circuit 40*a*.

In the timer control circuit, an off-time $V_{CE}$ voltage-holding circuit 47 is connected to the collector of the IGBT 2 and is configured so as to accept the input of a voltage applied to the collector when the IGBT 2 is turned off (this is the voltage of the battery 17), to store the voltage of the battery 17 so as to monitor variations therein, and to operate when the input signal 19 for turning on the IGBT 2 is input to the input terminal 7, in order to hold and output the voltage stored immediately prior to application of the input signal 19. By monitoring the collector-emitter voltage $V_{CE}$ of the IGBT 2 when it is turned off, the voltage value of the battery 17 can be detected accurately. The operational amplifier 48 is configured so as to operate when the input signal 19 for turning on the IGBT 2 is input to the input terminal 7, to compare the voltage of the battery 17 applied to the non-inverted input and held in the off-time $V_{CE}$ voltage-holding circuit 47 with the voltage of the reference-voltage source applied to the inverted input, and to send the result of the comparison to the timer circuit 14*a*. The timer circuit 14*a* is configured so as to output the main-current gradual-reduction start signal to the current-limiting/main-current gradual-reduction circuit 40*a* after a fixed period of time since the input signal 19 has been applied. However, the timer circuit operates, upon reception from the operational amplifier 48 the result of the comparison indicating that the voltage of the battery 17 is higher, to reduce the value of the time constant to shorten the length of time from the application of the input signal 19 to the output of the main-current gradual-reduction start signal.

According to this circuit, before the input signal 19 is applied to the input terminal 7, the off-time $V_{CE}$ voltage-holding circuit 47 holds the $V_{CE}$ voltage measured prior to application of the input signal 19, that is, the voltage of the battery 17. Once the input signal 19 has been applied, the operational amplifier 48 is simultaneously actuated to output the result of the comparison between the $V_{CE}$ voltage held by the off-time $V_{CE}$ voltage-holding circuit 47 and the voltage of the reference-voltage source 49, and a voltage-comparison result signal is input to the timer circuit 14*a*. Upon reception of the input of the voltage-comparison result signal, the timer circuit 14*a* outputs the main-current gradual-reduction start signal. The length of time from the application of the input signal 19 to the output of the main-current gradual-reduction start signal depends on the voltage-comparison result signal. That is, the timer circuit 14*a* outputs the main-current gradual-reduction start signal in a short time if the result of the voltage comparison indicates that the voltage of the battery 17 is higher.

Figure 8:
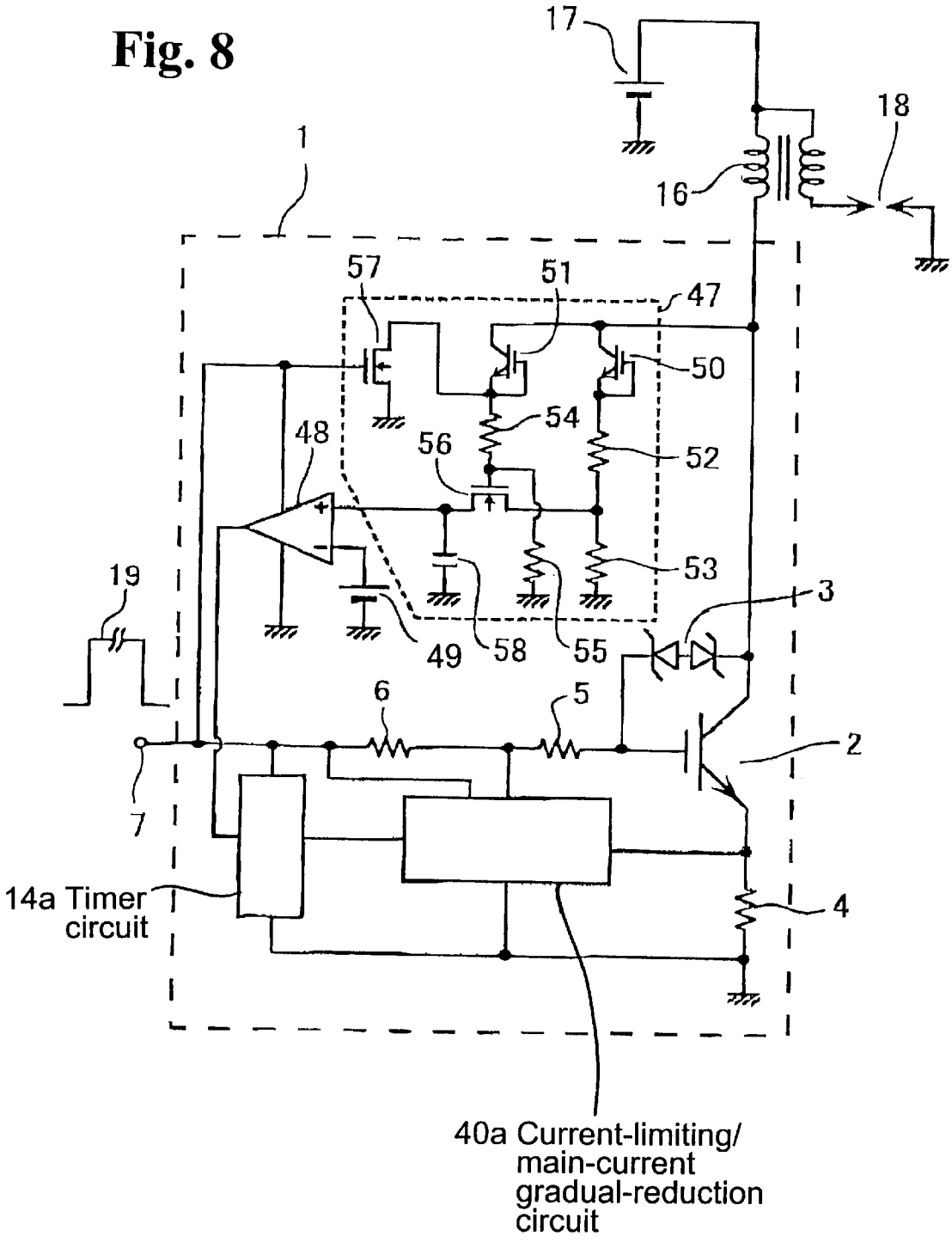
FIG. 8 is a circuit diagram showing in greater detail the configuration according to the sixth embodiment of the ignition semiconductor device.

FIG. 8 is a circuit diagram showing in greater detail a configuration according to the sixth embodiment of the ignition semiconductor device.

In this figure, the off-time $V_{CE}$ voltage-holding circuit 47 of the timer control circuit comprises two depression IGBTs 50 and 51, resistors 52 to 55, two MOSFETs (Metal-Oxide Semiconductor Field-Effect Transistor) 56 and 57, and a capacitor 58.

Each of the depression IGBTs 50 and 51 has a collector connected to the collector of the IGBT 2, and a gate and an emitter connected together and grounded via the resistors 52 and 53, and 54 and 55, respectively. The MOSFET 56 has a gate connected to a connection common to the resistors 54 and 55, a drain connected to a connection common to the resistors 52 and 53, and a source connected to the capacitor 58 and the non-inverted input of the operational amplifier 48. In addition, the MOSFET 57 has a gate connected to the input terminal 7, a drain connected to a connection common to the gate and the emitter of the depression IGBT 51, as well as to the resistor 54, and a grounded source. The power terminal of the operational amplifier 48 is connected to the input terminal 7, the inverted input is connected to the reference-voltage source 49, and the output is connected to the timer circuit 14*a*.

According to this circuit, when the input signal 19 causes the IGBT 2 to be turned off, a current proportional to the collector-emitter voltage $V_{CE}$ of the IGBT 2 flows through the depression IGBT 50, thereby causing a partial voltage to be generated at the connection common to the resistors 52 and 53. At this point, the partial pressure generated at the connection common to the resistors 54 and 55 due to the flow of a current through the depression IGBT 51 and the resistor 54 and 55 causes the MOSFET 56 to be turned on, so that the partial pressure generated at the connection common to the resistors 52 and 53 is supplied to and held in the capacitor 58 via the MOSFET 56.

Then, when the input signal 19 is applied to the input terminal 7, the MOSFET 57 is turned on to bring the gate voltage of the MOSFET 56 closer to the earth potential value in order to turn off the MOSFET 56, whereby the capacitor 58 holds a voltage corresponding to the voltage of the battery 17 measured immediately prior to the application of the input signal 19. In this case, at the same time that the input signal 19 is applied, the operational amplifier 48 is actuated by using the input signal 19 as a power supply to compare the voltage at the capacitor 58 with the voltage of the reference-voltage source 49 and to output the result of the comparison to the timer circuit 14*a*. When the timer circuit 14*a* accepts the input of the signal from the operational amplifier 48, if the result of the voltage comparison by the operational amplifier 48 indicates that the voltage of the battery 17 is higher, the timer circuit 14*a* outputs the main-current gradual-reduction start signal to the current-limiting/main-current gradual-reduction circuit 40*a* more quickly than when the voltage of the battery 17 is lower, thereby preventing the switching device from being thermally destroyed.

In the above-described example, the operational amplifier 48 and the reference-voltage source 49 are provided as a set to determine whether the voltage of the battery 17 is higher or lower than the specified value, and if the voltage is higher than this value, the main-current gradual-reduction start signal is output more quickly than that when the voltage is lower than this value. Multiple sets of the operational amplifiers and the reference-voltage sources may be provided to control the timer circuit 14*a* in such a manner that the amount of time required for the main-current gradual-reduction start signal to be output is sequentially reduced in accordance with the voltage of the battery 17.

Alternatively, the current-limiting/main-current gradual-reduction circuit 40 can be constructed through the use of the current-limiting circuit and main-current gradual-reduction circuit illustrated in FIG. 1, 4 or 5.

Figure 9:
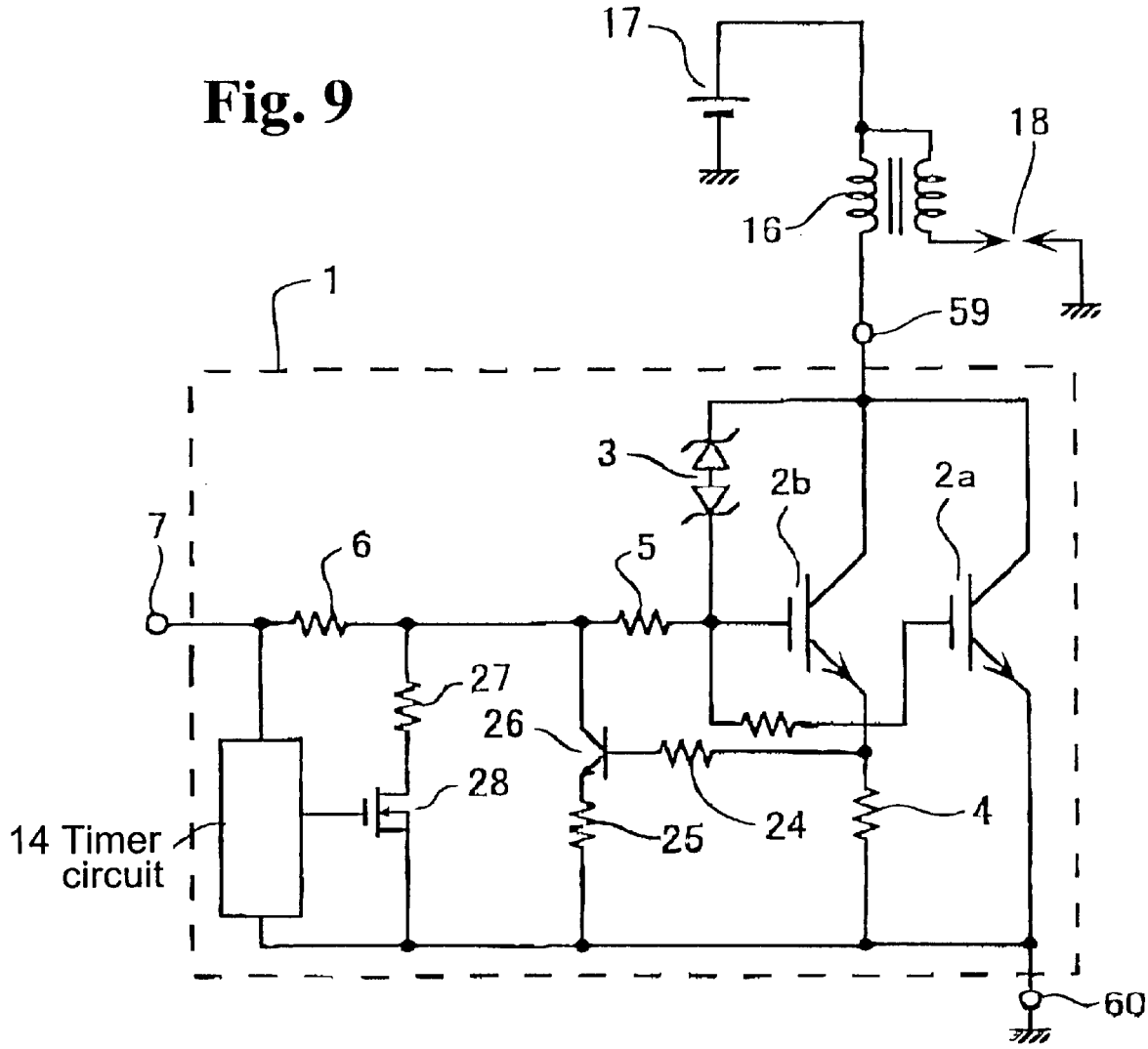
FIG. 9 is a view showing an example of an ignition semiconductor device including a single chip.

FIG. 9 is a view showing an example of an ignition semiconductor device constructed by a single chip. In FIG. 9, the same elements as shown in FIG. 4 are denoted by the same reference numerals, and detailed descriptions thereof are omitted. The ignition semiconductor device 1 is a monolithic integrated circuit comprising an IGBT 2*a* acting as an output-stage element for controlling the main current flowing through the ignition coil 16, an IGBT 2*b* for detecting the main current, a current-limiting circuit for limiting the main current, a Zener diode 3 for limiting or clamping the voltage emitted from the ignition coil, and a main-current gradual-reduction circuit, all being formed on a single silicon substrate. The ignition semiconductor device 1 includes an input terminal 7, an output terminal 59, and a ground terminal 60. Since this circuit does not allow a shunt resistor 4 with a large current-capacity value to be formed on the silicon substrate, the current-detecting IGBT 2*b* is connected parallel to the main-current-controlling IGBT 2*a* so that a part of the main current can be shunted to the IGBT 2*b* and detected in order to determine the value of the main current.

In the illustrated example, the current-limiting circuit and the main-current gradual-reduction circuit are those shown in FIG. 4, but may be those shown in FIG. 1, 3 or 5. Alternatively, the device may be configured so as to include the main-current cutoff circuit shown in FIG. 6 or the timer control circuit shown in FIG.

As described above, according to the present invention, the self-shut down circuit operating when the input signal is continuously input for a long time to cut off the ignition-coil current, even if the input signal is configured to turn off the output-stage element at a low speed. Consequently, in self-shut down, the output-stage element enters the OFF state more slowly than in a normal turn-off operation in order to restrain a high voltage from being generated in the ignition coil, thereby preventing an extraordinary rotational force from being applied to the engine. In addition, prevention of an extraordinary rotational force prevents abnormal sound or vibration from being generated in the engine, thereby providing a quieter vehicle.

A circuit is also provided to forcibly cut off the main current flowing through the switching device at a high speed if the battery voltage is high and the drive signal is applied continuously. This can prevent thermal destruction caused by the application of an excessive voltage to the switching device.

Furthermore, means is provided for storing and holding the battery voltage applied to the switching device while the switching device is off, and the timer circuit controls the length of time required for the main-current gradual-reduction start signal to be output, according to the battery voltage. As a result, the ignition semiconductor device can be configured as a conventional three-terminal package comprising an input terminal, an output terminal having an ignition coil connected thereto, and a ground terminal, without a terminal for monitoring the battery voltage. In addition, since the length of time required for the main-current gradual-reduction start signal to be output is controlled in accordance with the battery voltage, the switching device can be prevented from being thermally destroyed.

While the invention has been explained with reference to the specific embodiments of the invention, the explanation is illustrative and the invention is limited only by the appended claims.

What is claimed is:

1. An ignition semiconductor device for an ignition coil, comprising:

a switching device having a drive terminal and connected in series to the ignition coil to controllably turn on or off a current flowing through the ignition coil, a current-limiting circuit connected to the switching device for controlling the switching device to limit the current flowing through the ignition coil, a voltage-limiting circuit connected to the switching device for clamping a voltage emitted from the ignition coil, a timer circuit connected to the switching device, said timer circuit starting to operate in response to an input signal applied to the drive terminal of the switching device and outputting an output signal after a predetermined time from an application of the input signal, and a main-current gradual-reduction circuit connected to the timer circuit and the switching device, said main-current gradual-reduction circuit operating in response to the output signal from the timer circuit to reduce the current flowing through the switching device though the input signal is continuously applied.

2. An ignition semiconductor device according to claim 1, wherein said current-limiting circuit has a current-limit value, said main-current gradual-reduction circuit gradually reducing the current-limit value to turn off the switching device.

3. An ignition semiconductor device according to claim 2, wherein said current-limiting circuit comprises a shunt resistor connected in series with the switching device to detect a voltage value proportional to the current flowing through the switching device, a reference-voltage circuit for generating a reference-voltage value corresponding to the current-limit value, an operational amplifier for receiving the voltage value from the shunt resistor and the reference-voltage value as inputs, and a first transistor for controlling a voltage of the input signal applied to the drive terminal of the switching device, based on an output from the operational amplifier; and said main-current gradual-reduction circuit comprises a capacitor connected parallel to the reference-voltage circuit, a second transistor turned on in response to the output signal from the timer circuit, and a resistor connected in series with the capacitor and the second transistor to discharge a charge from the capacitor when the second transistor is turned on.

4. An ignition semiconductor device according to claim 2, wherein said current-limiting circuit comprises a shunt resistor connected in series with the switching device to detect a voltage value proportional to the current flowing through the switching device, a reference-voltage circuit for generating a reference-voltage value corresponding to said current-limit value, an operational amplifier for receiving the voltage value from the shunt resistor and the reference-voltage value as inputs, and a first transistor for controlling a voltage of the input signal applied to the drive terminal of the switching device, based on an output from the operational amplifier; and said main-current gradual-reduction circuit comprises an oscillation circuit operating in response to the output signal from the timer circuit, a shift circuit connected to the oscillation circuit for receiving an oscillation output from the oscillation circuit, a plurality of second transistors connected to the shift circuit to be turned on in response to each output signal from the shift circuit, and multiple resistors each having one end connected in series with a corresponding second transistor and the other end connected in common to the reference-voltage circuit, in order to reduce the reference-voltage value gradually.

5. An ignition semiconductor device according to claim 2, wherein said main-current gradual-reduction circuit comprises a transistor turned on in response to the output signal from the timer circuit, and a resistor connected in series with the transistor to shunt said input signal in order to reduce a voltage applied to the drive terminal of the switching device when the transistor is turned on, said resistor being connected parallel to the drive terminal of said switching device to discharge a charge stored in an input capacitance of the switching device.

6. An ignition semiconductor device according to claim 2, wherein said current-limiting circuit comprises a shunt resistor connected in series with the switching device to detect a voltage value proportional to the current flowing through the switching device, a reference-voltage circuit for generating a reference-voltage value corresponding to the current-limit value, an operational amplifier for receiving an input of the voltage value of the shunt resistor and an input of the reference-voltage value provided via a diode, and a first transistor for controlling a voltage of the input signal applied to the drive terminal of the switching device, based on an output from said operational amplifier; and said main-current gradual-reduction circuit comprises a capacitor connected parallel to the input terminal of the operational amplifier for receiving the input of the reference-voltage value, a second transistor turned on in response to the output signal from the timer circuit to disable an output of the reference-voltage circuit, and a constant-current discharge circuit connected parallel to the capacitor to discharge a charge from the capacitor.

7. An ignition semiconductor device according to claim 3, further comprising a main-current cutoff circuit for monitoring an inter-main-terminal voltage of the switching device and the voltage of the input signal applied to the drive terminal of the switching device and controlling the input signal to cut off a main current despite an operation of the main-current gradual-reduction circuit when the inter-main-terminal voltage has at least a predetermined value while the current-limiting circuit is performing a current-limiting operation.

8. An ignition semiconductor device according to claim 7, wherein said main-current cutoff circuit comprises a second operational amplifier for receiving an input of a voltage proportional to the inter-main-terminal voltage of the switching device and an input of a second reference voltage corresponding to the predetermined voltage, said second operational amplifier having a power supply from the voltage of the input signal applied to the drive terminal of the switching device, and a third transistor for controlling the voltage of said input signal based on an output from the second operational amplifier to turn off the switching device quickly.

9. An ignition semiconductor device according to claim 3, wherein said switching device comprises an off-time inter-main-terminal voltage-holding circuit for maintaining an inter-main-terminal voltage during a turn-off operation to monitor a voltage of a battery connected via the ignition coil, a reference-voltage source for generating a reference voltage corresponding to a value of the voltage of the battery when the voltage of the battery is at least a predetermined value, and a second operational amplifier having a power supply from the voltage of the input signal applied to the drive terminal of the switching device and comparing a voltage proportional to the voltage of the battery held in the off-time inter-main-terminal voltage-holding circuit with the voltage of the reference-voltage source, in order to output a signal to the timer circuit for reducing an amount of time from application of the input signal until the timer circuit outputs an output signal when the voltage value held in the off-time inter-main-terminal voltage-holding circuit exceeds the voltage at the reference-voltage source.

10. An ignition semiconductor device according to claim 9, wherein said off-time inter-main-terminal voltage-holding circuit comprises first and second voltage-dividing circuits for dividing a voltage at a main terminal on a side of the switching device connected to the ignition coil, a third transistor turned on by means of an output voltage from the second voltage-dividing circuit, a second capacitor for charging an output voltage from a first voltage-dividing circuit based on a turn-on operation of the third transistor, and a fourth transistor for turning off the third transistor when it is turned on by the voltage of the input signal applied to the drive terminal of the switching device.

11. An ignition semiconductor device according to claim 9, further comprising a plurality of sets of the second operational amplifiers and the reference-voltage sources with different voltage values, said timer circuit varying an amount of time required for the timer to output an output signal in accordance with the voltage of the battery.

12. An ignition semiconductor device according to claim 1, wherein said ignition semiconductor device is a hybrid integrated circuit comprising a combination of multiple parts forming the switching device, the current-limiting circuit, the voltage-limiting circuit, the timer circuit, and the main-current gradual-reduction circuit.

13. An ignition semiconductor device according to claim 1, wherein said ignition semiconductor device is a monolithic integrated circuit forming the switching device, the current-limiting circuit, the voltage-limiting circuit, the timer circuit, and the main-current gradual-reduction circuit configured on one silicon substrate.

14. An ignition semiconductor device according to claim 1, wherein said ignition semiconductor device is a single package comprising only multiple semiconductor chips constituting the switching device, the current-limiting circuit, the voltage-limiting circuit, the timer circuit, and the main-current gradual-reduction circuit.

15. An ignition semiconductor device according to claim 12, further comprising a main-current cutoff circuit for monitoring an inter-main-terminal voltage of the switching device and the voltage of the input signal applied to the drive terminal of the switching device, and for controlling the input signal so as to cut off the main current quickly despite an operation of the main-current gradual-reduction circuit when the inter-main-terminal voltage is of at least a predetermined value while the current-limiting circuit is performing a current-limiting operation.

* * * * *

UNITED STATES PATENT AND TRADEMARK OFFICE

CERTIFICATE OF CORRECTION

PATENT NO. : 6,336,448 B1
DATED : January 8, 2002
INVENTOR(S) : Shoichi Furuhata and Minoru Nishio It is certified that error appears in the above-identified patent and that said Letters Patent is hereby corrected as shown below:

Column 4,
Line 34, change "$V_{SW}$, When" to -- $V_{SW}$. When --;
Line 35, change "$I_L$," to -- $I_L$ -- and "$V_{SW}$, rises" to -- $V_{SW}$ rises --;
Line 48, change "$V_{SW}$, becomes" to -- $V_{SW}$ becomes --;

Column 5,
Line 3, change "$V_{SW}$, rises" to -- $V_{SW}$ rises --;

Column 6,
Line 3, change "secondary. winding" to -- secondary winding --;

Column 8,
Line 37, change "RCA" to -- RcA --; and

Column 11,
Line 67, change "FIG." to -- FIG. 8. --.

Signed and Sealed this

Seventh Day of May, 2002

*Attest:*

*Attesting Officer*

JAMES E. ROGAN
*Director of the United States Patent and Trademark Office*